US007913976B2

(12) United States Patent
Gaunt

(10) Patent No.: US 7,913,976 B2
(45) Date of Patent: Mar. 29, 2011

(54) FLOOR TOOL ASSEMBLY

(76) Inventor: Paul Maxwell Travis Gaunt, Gowrie (AU)

( * ) Notice: Subject to any disclaimer, the term of this patent is extended or adjusted under 35 U.S.C. 154(b) by 177 days.

(21) Appl. No.: 11/573,267

(22) PCT Filed: Aug. 5, 2005

(86) PCT No.: PCT/AU2005/001179

§ 371 (c)(1),
(2), (4) Date: Nov. 5, 2007

(87) PCT Pub. No.: WO2006/012706

PCT Pub. Date: Feb. 9, 2006

(65) Prior Publication Data

US 2008/0191180 A1 Aug. 14, 2008

(30) Foreign Application Priority Data

Aug. 5, 2004 (AU) ..... 2004904420

(51) Int. Cl.
*E04F 21/22* (2006.01)

(52) U.S. Cl. ..... 254/11; 254/16; 254/15

(58) Field of Classification Search ..... 254/11, 254/12, 15, 16

See application file for complete search history.

(56) References Cited

U.S. PATENT DOCUMENTS

| | | | | | |
|---|---|---|---|---|---|
| 1,142,452 | A * | 6/1915 | Oliver | 188/67 |
| 3,143,335 | A * | 8/1964 | Lassahn | 254/11 |
| 4,332,203 | A * | 6/1982 | Flowers | 105/422 |
| 5,845,548 | A * | 12/1998 | Nelson | 81/46 |
| 6,402,121 | B1 * | 6/2002 | Marcon | 254/11 |
| 7,451,671 | B2 * | 11/2008 | Coleman, Jr. | 81/46 |
| 2008/0191180 | A1 * | 8/2008 | Gaunt | 254/11 |

FOREIGN PATENT DOCUMENTS

| | | |
|---|---|---|
| AU | 13886/23 | 8/1923 |
| AU | 18894/24 | 7/1924 |
| AU | 111371 | 8/1939 |
| AU | B-64668/94 | 12/1994 |
| EP | 0 808 964 A2 | 11/1997 |
| EP | 1 072 735 B1 | 1/2001 |
| SU | 614197 | 7/1978 |

* cited by examiner

*Primary Examiner* — Lee D Wilson

(74) *Attorney, Agent, or Firm* — Seed Intellectual Property Law Group PLLC

(57) ABSTRACT

A tool for pressing together flooring panels to be fixed in place one relative to the other(s), wherein a first part of the tool has a foot portion for abutting against a surface, a second part of the tool has a head portion for abutting against an end one of the flooring panels, and the second part is movable relative to the first part for exerting force on the end flooring panel.

23 Claims, 9 Drawing Sheets

FLOOR TOOL ASSEMBLY

FIELD OF THE INVENTION

This invention relates to a floor tool, and more particularly, but not exclusively, to a floor tool for compressing together flooring panels such as tongue-and-groove floorboards before they are fixed in place to form a floor surface.

BACKGROUND OF THE INVENTION

It is known to provide a floor surface formed by a series of floorboards placed together in parallel abutting relationship. It is also known to form the floorboards as "tongue-and-groove" floorboards such that each board has a female groove along one edge and a male "tongue" protrusion along the other edge, the grooves and tongues being correspondingly shaped such that the tongue of one floorboard fits within the groove of a neighbouring floorboard.

So as to minimise gaps in the resulting floor surface, tongue-and-groove floorboards are conventionally compressed together, commonly by hand with a mallet and chisel. However, such techniques often do not enable one person to sufficiently compress together the boards to remove gaps between the floorboards, particularly where the floorboards have bends and/or twists.

SUMMARY OF THE INVENTION

In accordance with one aspect of the present invention, there is provided a tool for pressing together flooring panels to be fixed in place one relative to the other(s), wherein a first part of the tool has a foot portion for abutting against a surface, a second part of the tool has a head portion for abutting against an end one of the flooring panels, and the second part is movable relative to the first part for exerting force on the end flooring panel.

Preferably, the tool is provided with a mechanism coupled to the first and second parts, operable to move the second part relative to the first part.

In one form, the mechanism is pneumatically powered. In another form, the mechanism is manually powered. In alternative forms, the mechanism is hydraulically powered, electrically powered, battery powered and/or electrically powered. The power-operated mechanism may be powered by other means in addition to or in place of the means listed above.

Alternatively, the mechanism is provided with a manually operable lever which is articulated between the first and second parts of the tool to provide leverage to move the second part relative to the first part.

Preferably, the first and second parts are in a sleeved arrangement such that the second part is movable relative to the first part is response to operation of the lever so as to extend the tool.

Preferably, the foot is adapted to bear against a substantially vertical surface, such as a wall.

Preferably, the head portion includes a detachable head extension for increasing a width over which force is exerted on the end flooring panel. More preferably, the head extension is adapted for contact with the end flooring panel at a plurality of locations along its width. Preferably, the head portion is provided with at least one portion of a flooring panel as an interface for mating with the end flooring panel.

Preferably, the flooring panels are tongue-and-groove flooring panels.

Preferably, the first part includes an extendable portion relative to which the foot portion is mounted, and the extendable portion is able to be locked at different positions to provide different lengths of the first part. More preferably, the extendable portion is able to be locked at different positions by way of a locking pin arrangement. Preferably, the extendable portion has an adaptor which has a bearing portion inwardly of the ends of the tool when the adaptor is in place, to facilitate use of the tool in situations where a distance between the end flooring panel and said surface is less than the length of the tool. Preferably, the bearing portion is provided with a portion of a flooring panel as an interface for mating with the end flooring panel.

Preferably, the adaptor is interchangeable with other extendable portions.

Preferably, the tool is provided with a lock for locking relative movement between the first part and the second part.

In accordance with another aspect, there is provided a tool for pressing together flooring panels to be fixed in place one relative to the other(s), wherein a first part of the tool has a foot portion for providing anchorage, a second part of the tool has a head portion with spaced abutments for abutting against an end one of the flooring panels, and the second part is movable relative to the first part for exerting force on the end flooring panel.

Preferably, the spacing between the abutments permits access for fastening said end one of the flooring panels to an underlying surface. The fastening of the end flooring panel to the underlying surface may be achieved by way of nailing, particularly where a nail is driven into an outer edge (eg. into an edge tongue of the flooring panel) of the flooring panel so as to be hidden from view.

Preferably, the flooring panels are floorboards.

In accordance with another aspect of the invention, there is provided a method of pressing together flooring panels to be fixed in place one relative to the other(s), including the steps of:

abutting a foot portion of a first part of a tool against a surface;

abutting a second part of the tool relative to an end flooring panel; and moving the second part relative to the first part to extend the tool so as to move the end flooring panel relative to the surface.

Preferably, the method includes the step of adjusting a bearing portion of the tool to a position inwardly of ends of the tool, abutting the bearing portion against the end flooring panel, and moving the bearing portion relative to the first part so as to move the end flooring panel relative to the surface. More preferably, the method includes the step of locking the bearing portion relative to the second portion.

Preferably, the bearing portion is provided with a portion of a flooring panel as an interface for mating with the end flooring panel.

Preferably, the method includes the step of abutting the foot portion of the first part of the tool against a substantially vertical surface, such as a wall.

In accordance with another aspect, there is provided a method of pressing together flooring panels to be fixed in place one relative to the other(s), including the steps of:

providing anchorage with a foot portion of a first part of a tool;

abutting spaced abutments of a second part of the tool relative to an end flooring panel; and moving the second part relative to the first part to extend the tool so as to move the end flooring panel relative to the foot portion.

Preferably, the method further includes the step of fastening said end one of the flooring panels to an underlying surface between the spaced abutments.

Preferably, the flooring panels are floorboards.

BRIEF DESCRIPTION OF THE DRAWINGS

The invention is described, by way of non-limiting example only, with reference to the accompanying drawings in which.

DETAILED DESCRIPTION

Figure 1:
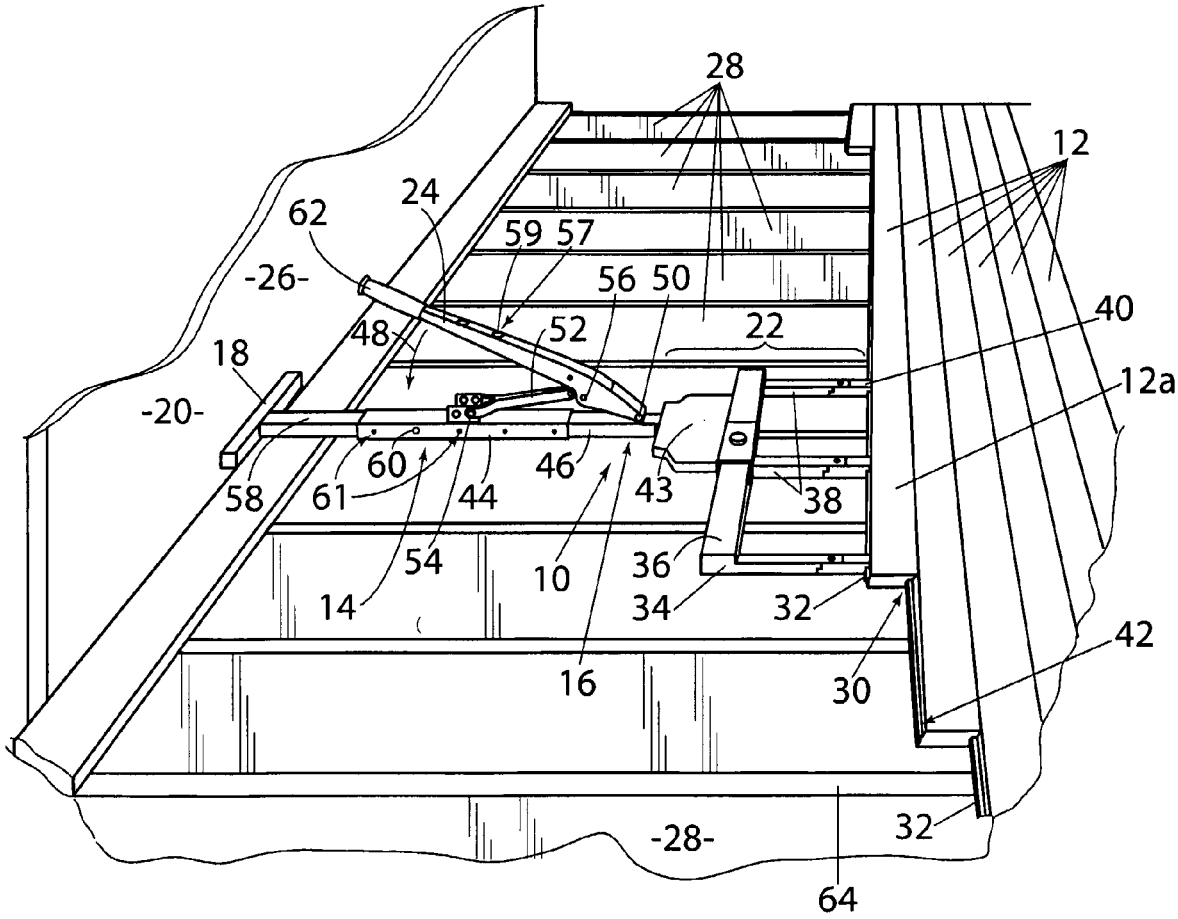
FIG. 1 is a side perspective view of a manually operated tool for pressing together floorboards, in accordance with a first example.
Figure 2:
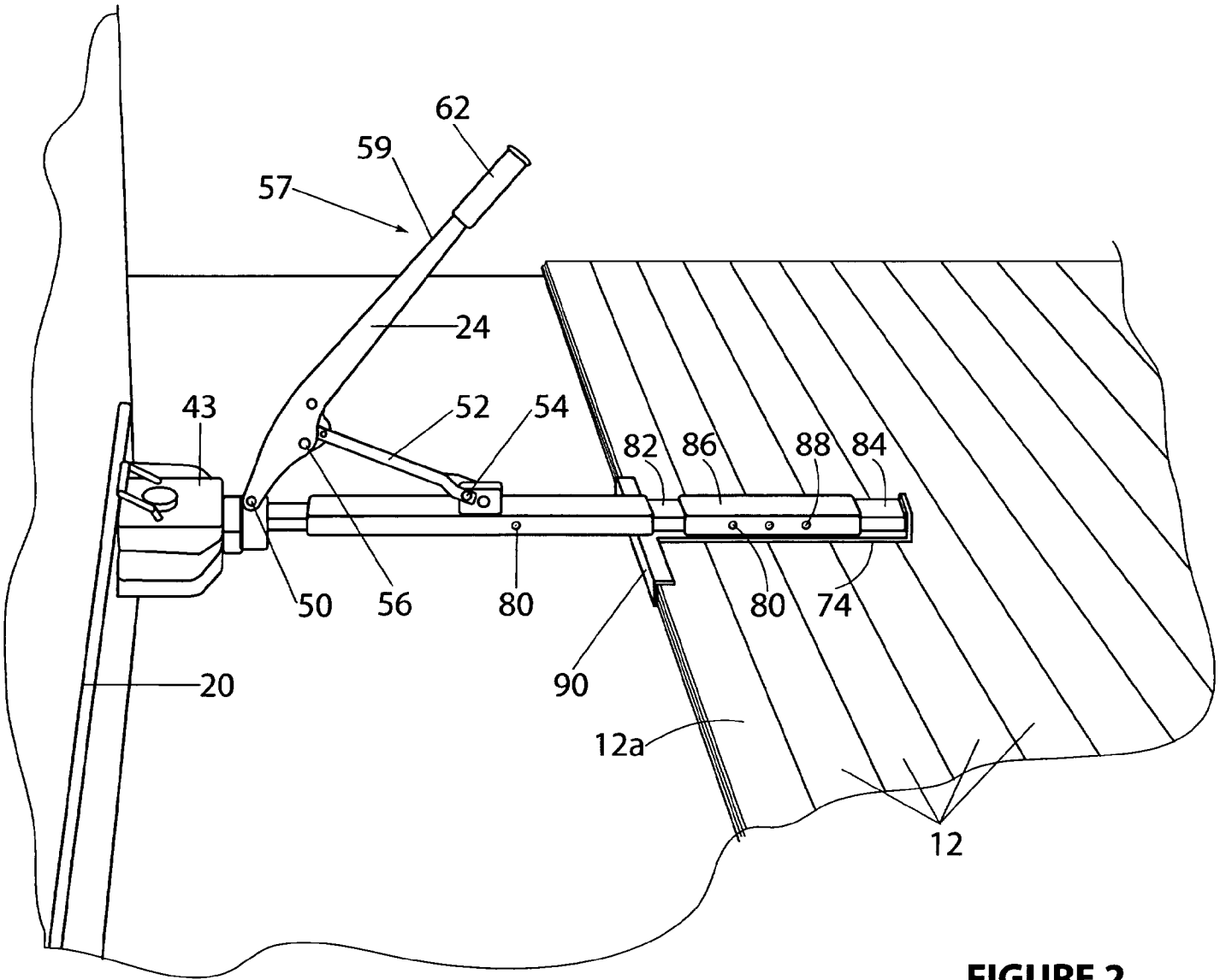
FIG. 2 is a side perspective view of the tool of FIG. 1, shown pressing together a series of floorboards with use of an adaptor, a lever of the tool being in a raised position.

A manually operated tool 10 for pressing together floorboards 12 in accordance with a first example is shown in FIGS. 1 and 2, and includes a first part 14 with a second part 16 being movable relative to the first part 14. The first part has a foot portion 18 for abutting against a surface 20, and the second part 16 has a head portion 22 for abutting against an end floorboard 12*a*. An articulated lever 24 between the first part 14 and the second part 16 is manually operable to cause movement of the second part 16 relative to the first part 14 so that the tool extends, thus pressing together the floorboards 12. By use of the tool 10, floorboards 12 are able to be pressed together prior to being fixed in place one relative to the other to minimise or prevent gaps between the floorboards 12. Once pressed together, the floorboards 12 may be fixed in place one relative to the other, for example, by way of adhesive and/or fasteners.

With particular regard to FIG. 1, there is shown the tool 10 located between a surface 20 in the form of a wall 26 and a series of floorboards 12 laid side by side on a plurality of supporting beams 28. The floorboards 12 are of a "tongue-and-groove" type, such that each floorboard 12 has on one side edge a groove 30 and on its opposite side edge a tongue 32. In this way, the tongue 32 of one floorboard 12 fits inside the groove 30 of a neighbouring floorboard 12 to facilitate tight fitting together of the floorboards 12, and to prevent upward/downward bending of one floorboard 12 relative to its neighbouring floorboards 12.

The head portion 22 is pivotably mounted to the second part 16 so that it is able to adapt to the orientation of the end floorboard 12*a*. This enables force to be applied evenly to the end floorboard 12*a* and reduces the likelihood of damage to the end floorboard 12*a*. The head portion 22 includes a head extension 34 having a lateral bar 36 from which three extension arms 38 extend. The extension arms 38 may be extendable, for example to be extended laterally so as to widen the interval between the arms to as to prove a broader spread of force applied to the floorboards. Each of the extension arms 38 has a toe 40 formed from part of a tongue-and-groove floorboard such that the toe 40 has an outward facing groove 42 which meets with the tongue 32 of the end floorboard 12*a*. Where the head extension 34 is not needed, the head unit 43 itself may be brought into direct contact with the end floorboard 12*a* and is preferably provided with a portion of a floorboard with an outward facing groove 42 for mating with the tongue 32 of the end floorboard 12*a*. The head extension 34 provides the tool 10 with a greater reach such that it is able to be used to press together floorboards 12 at a greater distance from surface 20, for example as may occur for the first few floorboards 12 laid. The head extension 34 also provides the benefit of distributing the force exerted by the tool 10 across the width of the head extension 34, as distributed at the locations where the toes 40 abut against the end floorboard 12*a*, the width of the head extension 34 being greater than the width of an integral head unit 43 of the tool 10. Obviously, during laying of an entire floor, each successive floorboard 12 laid in side by side arrangement with the other floorboards 12 becomes the new end floorboard 12*a* against which the tool 10 is used. The tool 10 may be used against each successive end floorboard 12*a*, for example in situations where the pressing together of the floorboards 12 is difficult, or may be used less if adequate or near-adequate pressing together of the floorboards 12 is achievable by hand.

Figure 4:
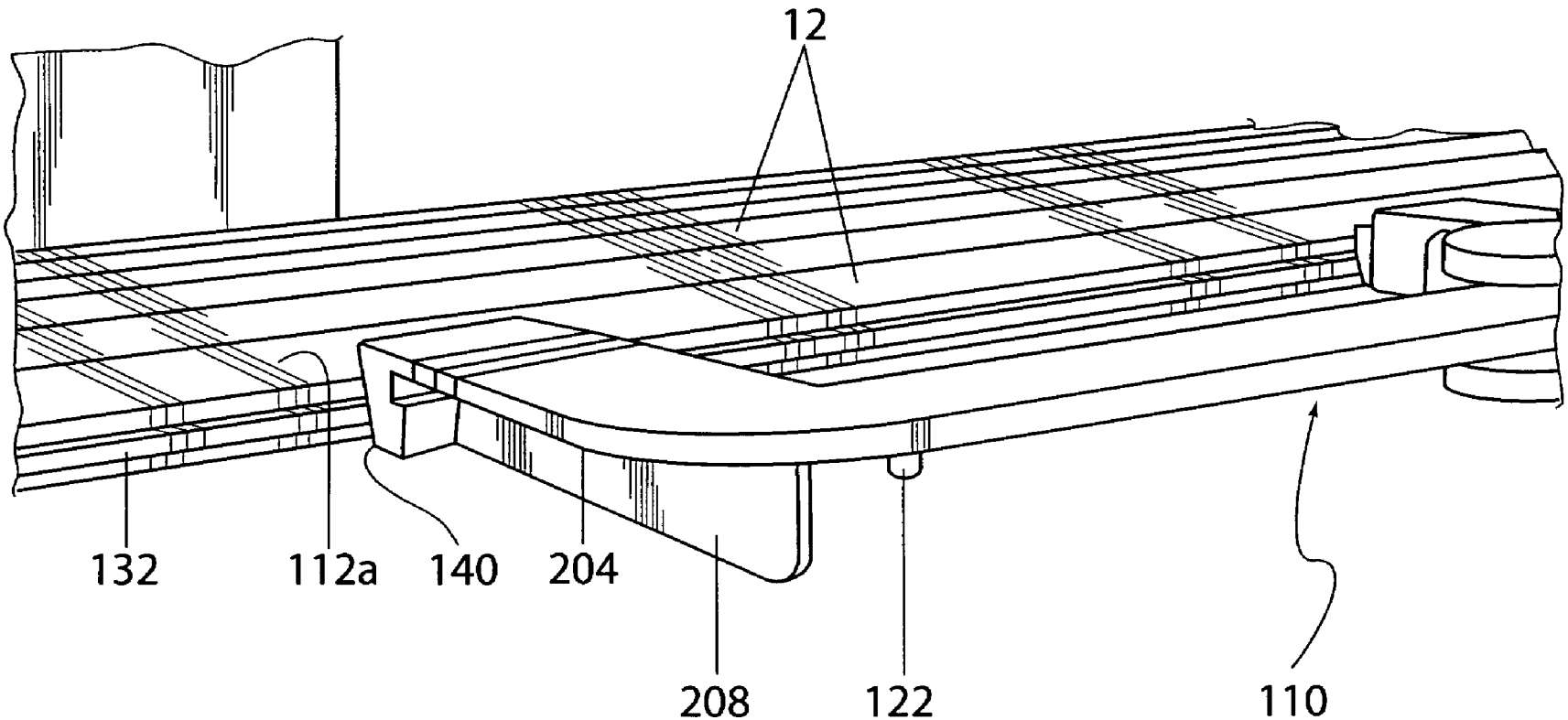
FIG. 4 is a close-up rear perspective view of a head portion of the tool shown in FIG. 3.

The first part 14 has an elongated tubular metal member 44 which is in sleeved arrangement with an elongated tubular metal member 46 of the second part 16. Tubular member 46 is able to slide in and out relative to tubular member 44 in response to movement of the lever 24. More particularly, downward movement of the lever 24 in the direction of arrow 48 causes the tubular member 46 to slide out of the tubular member 44 such that the tool 10 is extended. The lever 24 is pivotally coupled to the second part 16 by pivot 50, and is coupled to the first part 14 by way of strut 52. The strut 52 is pivotally coupled at one end to the first part 14 by pivot 54, and is pivotally coupled to the lever 24 at its other end by pivot 56. Pivot 56 is spaced from pivot 50 such that the lever provides mechanical advantage so that a force manually applied to the lever 24 results in a greater force acting at pivots 54 and 50 for encouraging extension of the tool 10. By way of this mechanical advantage, greater forces are able to be applied for pressing together of the floorboards 12 than are possible manually. The tool 10 may be provided with a lock 57 (for example with a switch 59 mounted on the lever 24 as shown in FIG. 4) which is selectively operable so as to prevent relative movement between the first part 14 and the second part 16. The lock 57 may prevent relative movement in both directions, or only in one direction such that additional pressure can be applied while preventing existing pressure from being unintentionally released without disengagement of the lock 57.

The first part 14 includes an extension bar 58 to an end of which the foot portion 18 is mounted. The opposite end of the extension bar 58 fits inside of tubular member 44 and is slidable relative to the tubular member 44. The extension bar 58 is provided with a locking pin 60 which fits in corresponding apertures 61 in the wall of tubular member 44 such that the extension bar 58 is able to be locked at different positions relative to the tubular member 44 to provide different lengths of the first part 14.

For use of the tool 10 in pressing together floorboards 12 as shown in FIG. 1, firstly the head portion 22 is placed in abutment with the end floorboard 12*a*. When using the head extension 34, as shown, the arms 38 of the head extension 34 are brought to abut against the endmost floorboard 12*a* with the grooves 42 of the toes 40 meeting with the tongue 32 of the end floorboard 12*a*. As the toes 40 of the tool shown in FIGS. 1 and 2 are made from wood (preferably the same wood from which the floorboards 12 are made), damage to the endmost floorboard 12*a* is minimised. The integral head unit 43 of the main body 68 of the tool 10 is then brought into contact with the edge of the lateral bar 36, and may be slid along the edge of the lateral bar 36 to act on different parts of the bar 36, as required.

With the lever 24 in an upward configuration (as shown in FIG. 1) the extension bar 58 is adjusted to a suitable position relative to a tubular member 44 by way of the locking pin 60, preferably such that the foot portion 18 is as close as possible to surface 20 with locking pin 60 engaged in one of the corresponding apertures in tubular member 44. The lever 24 is then brought downward along the path indicated by arrow 48, by way of the user's hand applying downward force to grip 62. By way of the mechanical advantage as explained earlier, the downward movement of the lever 24 causes tubular member 46 to slide outward from tubular member 44 such that the tool 10 extends, thus pressing together the floorboards 12. Adhesive 64 may be pre-laid on the upper edges of the supporting beams 28 so that the floorboards 12 are able to be fixed in place. The floorboards 12 may be held in place during setting of the adhesive 64 by leaving the tool 10 in place once it has been used to press together the floorboards 12, or by nailing of the floorboards to the underlying surface prior to removing the tool.

FIG. 2 shows an adaptor 74 which is used for adapting the tool 10 to applications wherein the distance available between the end floorboard 12*a* and the surface 20 is less than the length of the tool 10. For applications of this type, the adaptor 74 is fitted to the tubular member 44 in place of the extension bar 58. The adaptor 74 is coupled to the tubular member 44 by a locking pin arrangement. An extension pole 82 may be used between the tubular member 44 and the adaptor 74, as required, to suit the specific application. The extension pole 82 shown in FIG. 2 is provided with locking pins 80 at either end to engage with corresponding apertures in the tubular member 44 and the adaptor 74.

The adaptor 74 has a movable insert 84 which is slidable inside of a tubular member 86 of the adaptor 74, and is able to be supported in position relative to the tubular member 86 during use of the tool 10 by way of locking pin 88. The movable insert 84 has a bearing portion 90 which is located inside of the ends of the tool 10 when the adaptor 74 is in place. By virtue of the bearing portion 90 being inside of the ends of the tool 10, the tool 10 is able to be used for pressing together floorboards 12 even when the end floorboard 12*a* is located closer to the surface 20 than the length of the tool would otherwise allow. The bearing portion 90 may be provided with a portion of a floorboard as an interface for mating with the end floorboard 12*a*, in a manner similar to that shown in FIG. 1 for the head extension 34. In an alternative example, the bearing portion 90 may be pivotably mounted (for example by a pin) so as to be able to adapt to the orientation of the end floorboard 12*a*, to allow for the tool 10 not being perpendicularly oriented relative to the floorboards. Where the tool 10 is used within small spaces in this way, the head unit 76 may be used to abut directly with surface 20 (ie. without the head extension 34).

Advantageously, as the tool 10 is anchored by abutting against a surface rather than by embedding in an underlying beam, the tool 10 is not limited to applications having penetrable objects beneath the floor, and thus may also be used, for example, in laying floorboards above a concrete slab. By virtue of the extendable portion and adaptor providing a range of lengths of the tool 10, the tool 10 is able to be used for a range of distances between the floorboards and the anchoring surface.

The above example of the tool has been described by way of example only and modifications are possible within the scope of the invention. Although the tool 10 shown in the Figures is adapted from a carpet stretcher, in other examples the tool may be purpose built.

FIGS. 3 to 9 show an alternative tool 110 which is power-operated. The particular example shown is pneumatically operated, however it will be understood by those skilled in the art that other forms of power operation may be used instead of or in addition to the pneumatics. The tool 110 uses the same fundamental concept as in the tool 10 shown in FIGS. 1 and 2, only with a pneumatic unit 192 providing the force for moving the second part 116 relative to the first part 114 for pressing together floorboards 112 rather than the articulated lever arrangement 24. Like features of the tool 110 have been denoted with like reference numerals to those used in describing the tool 10, in the 100 series.

Figure 3:
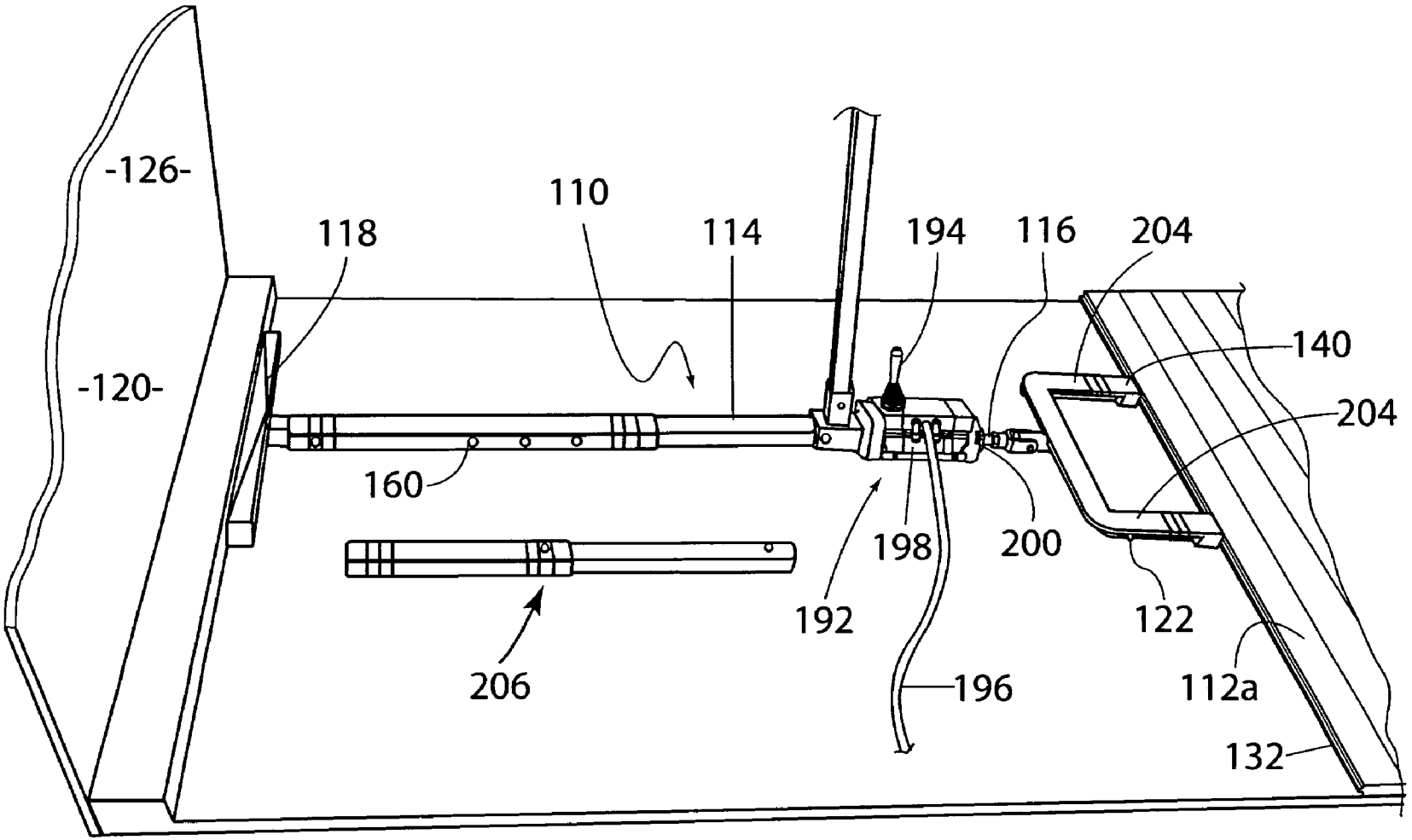
FIG. 3 is a side perspective view of a pneumatic tool for pressing together floorboards, in accordance with a second example.

With reference to FIG. 3, the pneumatic unit 192 has an actuating lever 194 and receives pressurised air from a supply hose 196. The actuating lever 194 is biased to a central position (as shown) wherein the position of the second part 116 relative to the first part 114 is locked by virtue of valves to pneumatic cylinder 198 being closed. The lever 194 is able to be moved forward and backward to selectively open the valves to the cylinder 198 so as to move a piston 200 of the cylinder 198 outward or inward, thus extending or contracting the tool 110, respectively. The pneumatic unit 192 is provided with a speed adjustment for altering the speed at which the piston 200 moves in response to actuation of the lever 194.

The head portion 122 is pivotably mounted to the second part 116 so as to adapt to the surface of the endmost floorboard 112*a*, and has a pair of spaced arms 204. Each arm 204 is provided with an abutment in the form of a toe 140 shaped for non-damaging contact with the endmost floorboard 112*a*. A spacing between the arms 204 enables easy access for fastening of the endmost floorboard 112*a* to an underlying surface, for example by driving a nail through the tongue and into the underlying surface, before removal of the tool. The toes 140 are fitted to the arms 204 by interference fit so that they can be removed, replaced and interchanged with other toes to suit the specific size and profile of the floorboards 112 being pressed together. The toes may be formed from polyurethane and, ideally, a series of toes 140 will be available with different sizes and profile shapes to suit the different edge characteristics of floorboards commonly used.

The first part 114 may be lengthened or shortened by way of an adjustable sleeved arrangement which uses locking pins 160 as in the manual tool 10 of FIGS. 1 and 2. Interchangeable lengths 206 may also be provided for further adjusting the length of the tool 110.

The tool 110 is provided with a handle 202, shown in the form of a vertical bar in the example depicted, for facilitating handling of the tool 110.

With reference to FIG. 4, the arms 204 are provided with vertical rails 208 on their undersides to minimise contact with adhesive (not shown) which may be applied to a ground surface 210 for adhesion to the floorboards, for example when "trowel gluing".

Figure 5:
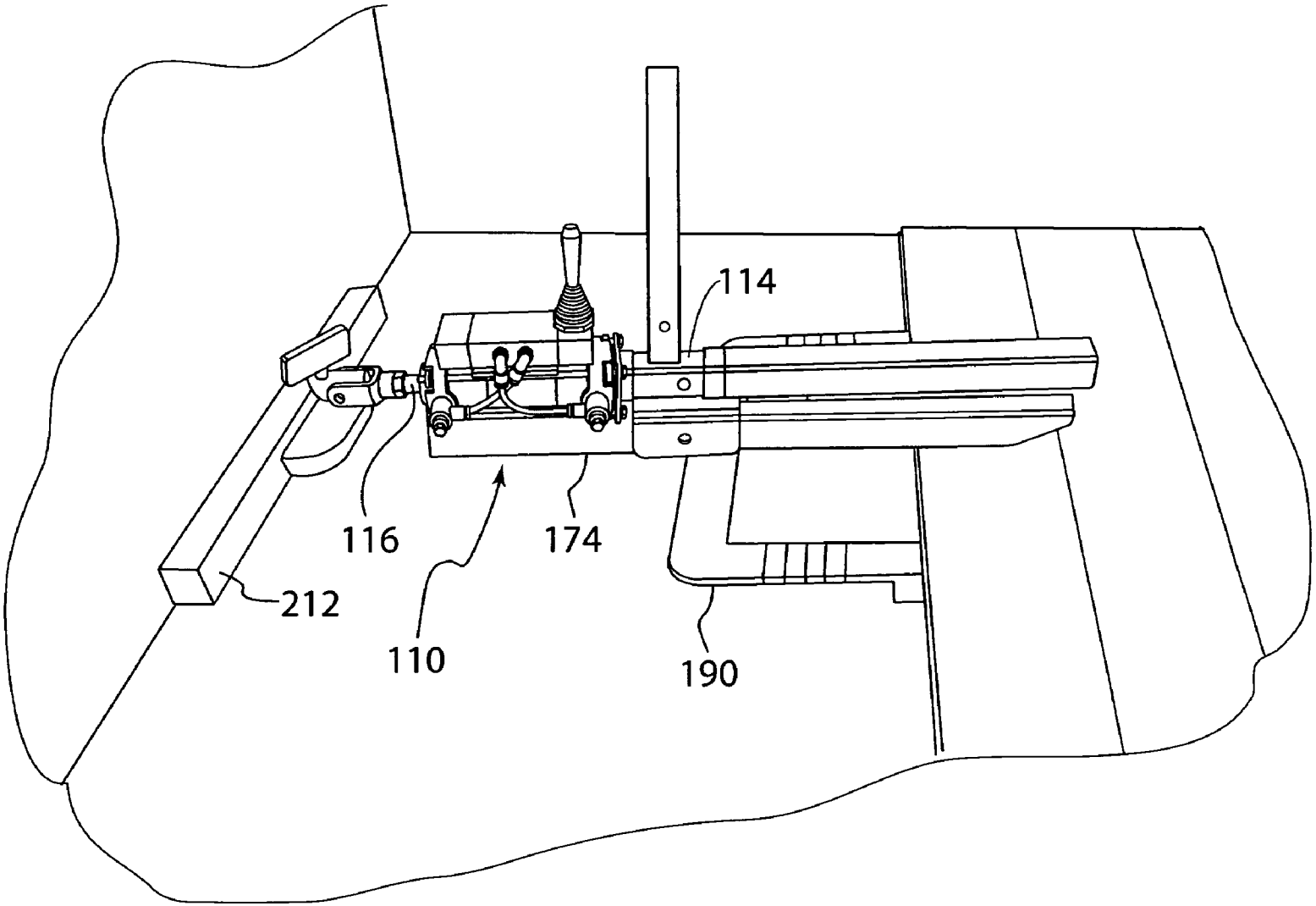
FIG. 5 is a side perspective view of the tool of FIGS. 3 and 4, shown pressing together a series of floorboards with use of an adaptor.
Figure 6:
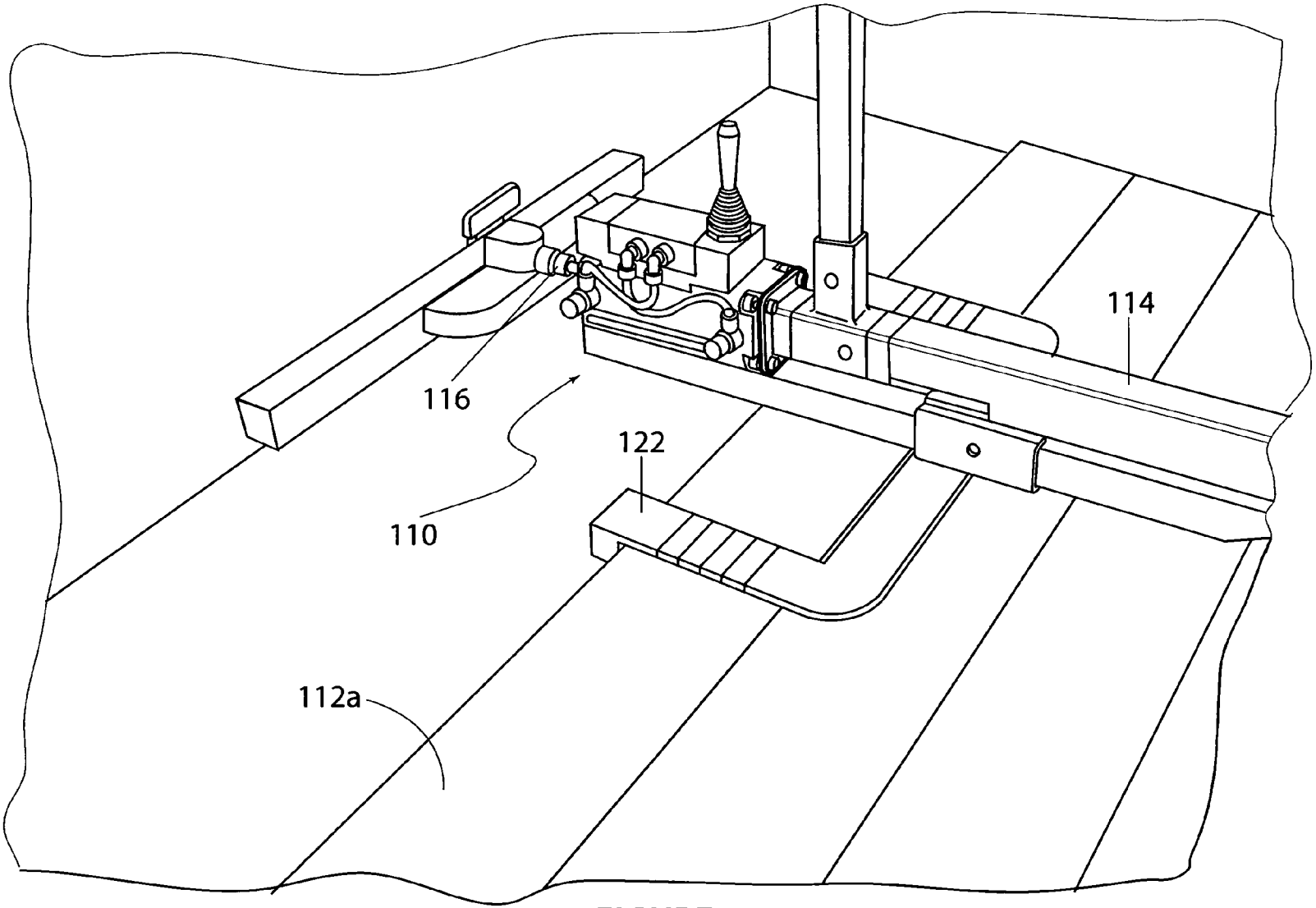
FIG. 6 is a side perspective view of the tool of FIGS. 3 to 5, shown pressing together a series of floorboards with use of the adaptor in a reversed configuration.
Figure 7:
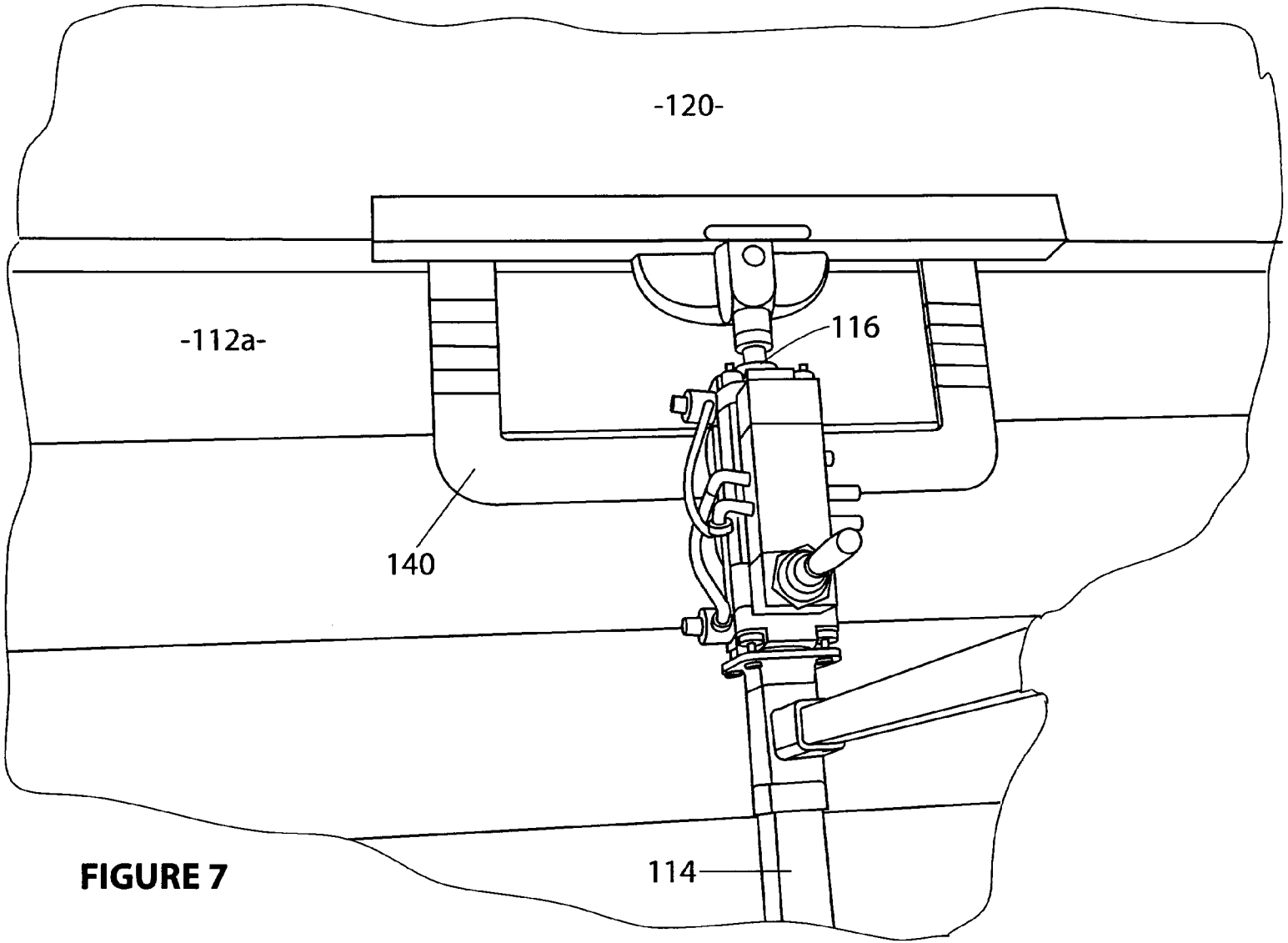
FIG. 7 is a top perspective view of a head portion of the tool of FIGS. 3 to 6, shown nearing completion of laying a series of floorboards.

Quick release mechanisms couple the head portion 122 and foot portion 118 to the remainder of the tool 110 to facilitate quick and easy removal and replacement with an adaptor 174 and an adaptor foot 212, for situations where a distance between the endmost floorboard 112*a* and the surface 120 is less than the length of the tool 110, for example as shown in FIG. 5. A bearing portion 190 of the adaptor 174 is able to be moved along the adaptor 174, intermediate ends of the tool 110, by way of a locking pin arrangement. Accordingly, use of the tool 110 is enabled right up until a point where the bearing portion 190 approaches being level with the adaptor foot 212, as shown in FIG. 7. As can be seen, advantageously, the tool 110 is configured such that the bearing portion 190 is able to move below the adaptor foot 212 so as to allow use of the tool 1 10 within very confined spaces.

Figure 8:
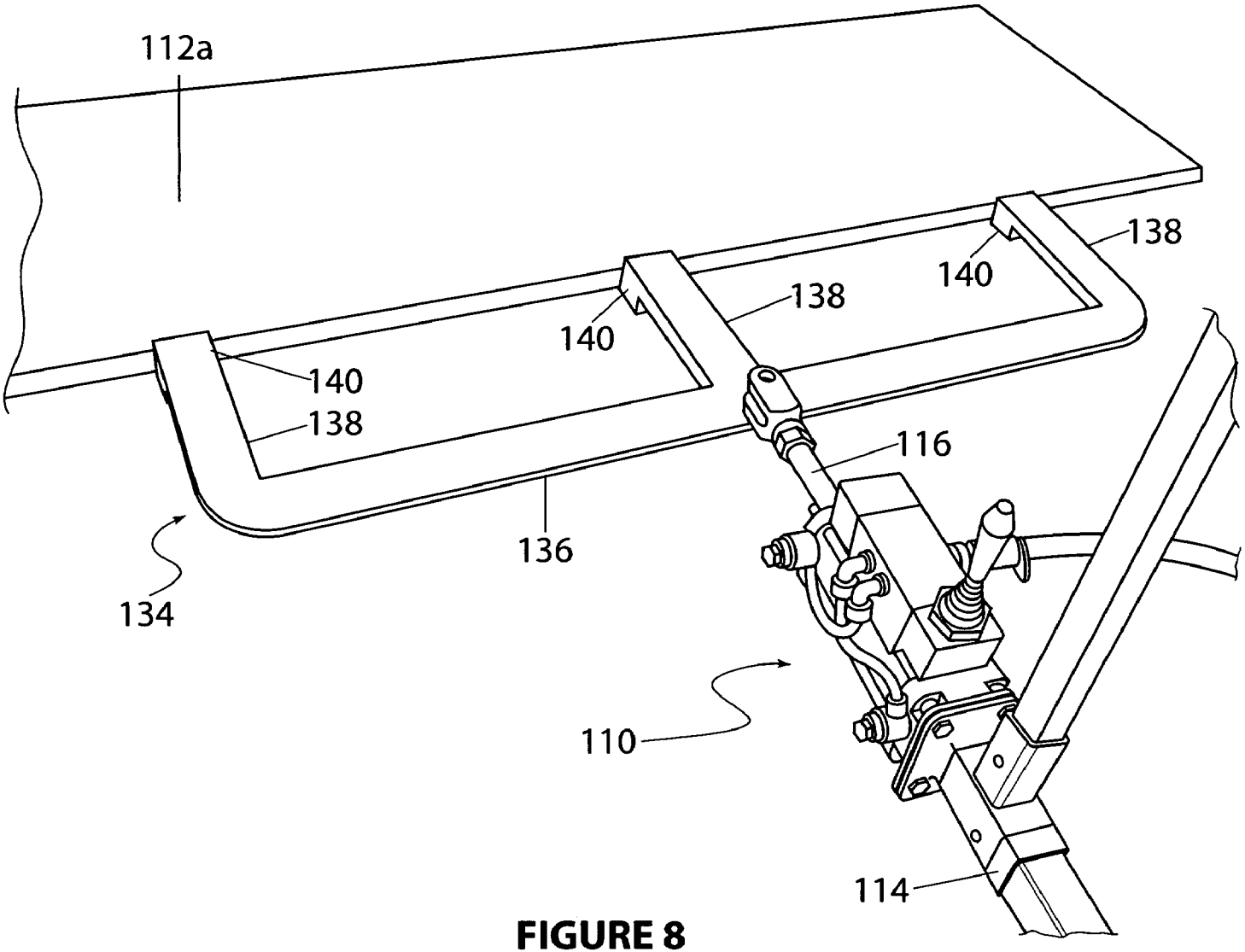
FIG. 8 is a top rear perspective view of the tool of FIGS. 3 to 7, shown pressing together floorboards using a head extension.

With reference to FIG. 8, the tool 110 is able to be used with a head extension 134 for increasing the ability of the tool 110 to straighten bent floorboards. Arms 138 of the head extension 134 are fitted with interchangeable toes 140, which may be the same as those described above.

Figure 9:
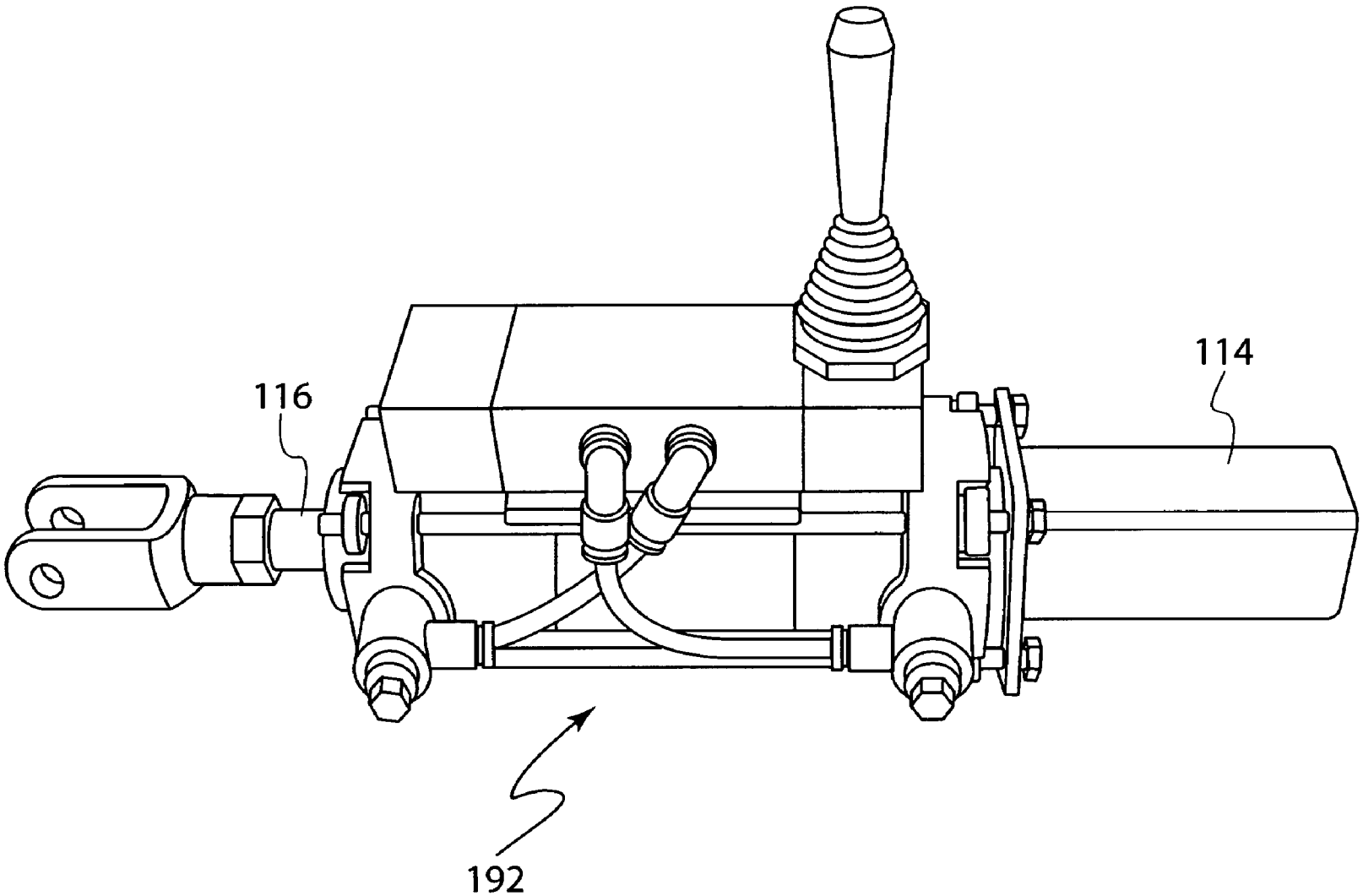
FIG. 9 is a side perspective view of a pneumatic piston and controller of the tool shown in FIGS. 3 to 8.

FIG. 9 shows a detailed view of the pneumatic unit 192 decoupled from other parts of the tool 110.

Although the tools 10, 110 shown in the Figures are made primarily from metal, it will be understood that in alternative examples the tool may be made from plastic, graphite composite, polyurethane and/or other materials.

It will be understood by those skilled in the art that although the above description of the examples shown is made with reference to use of the tool in pressing together floorboards, the tool may also be used for pressing together other flooring panels. Such flooring panels include, for example, flooring panels requiring inter-mating and veneer-type flooring panels used in forming "floating" floors.

EXAMPLE

In one example, the tool is sold in a kit containing the following:

1×Bag
1×Detachable trolley
1×Control lever
1×Cylinder attachment
1×Handle
Extension Poles:
2×1500 mm
2×1000 mm
1×550 mm
1×310 mm
1×Main head
1×Extension head
1×Return bar head
1×Return bar (Adaptor)
1×Wall foot
1×Return foot (for use with the Adaptor)
7×Connecting blocks (toes) for "secret" nail and traditional profiles
(One set fits 19 mm, 22 mm and 25 mm floorboards)
7×Connecting blocks (toes) for "secret" nail and traditional profiles
(One set fits 10 mm and 12 mm overlay)

The tool is operated according to the following instructions:

1. Determine the distance of the span required to commence pressing, so as to determine which tool components to use. For example, if the span is 6 m, both 1500 mm extension poles are used in series, each of the poles being extended to approximately 3 m.
   Holes in the extension poles are provided at 80 mm spacings. The stroke of the pneumatic ram is approximately 100 mm. The tool has been demonstrated to be useable with all board widths, shortening the extension pole(s) by one hole position for each successive board, or by two hole positions in cases where the boards are more than 160 mm wide.
2. Attach the wall foot to the extension poles. When setting the wall foot against the wall, use full length floorboards right across the wall pushing area to ensure not to damage the wall. Failure to do this may result in damage to the wall. Attach the air cylinder connection to the other end.
3. Attach the main head to the yoke on the ram.
4. Before connecting the air line check and set the regulator on compressor to 100 psi up to 130 psi (cylinder designed to run on the same pressure as most nailers). Connect air line to air cylinder. Test travel on ram first. Take care as the ram can move quickly when the valves fill with air. The ram is tested and set when packed for export so no further setting is required on the speed controls (they are set to push out slowly and to reverse quickly.)
5. To clamp boards, adjust the tool into position so that pushing angle is approximately 90 degrees to the floor. The tool will still press together floorboards at angles up to 45 degrees, but may slide until a firm setting is found).
6. Select appropriate connecting blocks and push them into slots on the main head. Align the connecting blocks with the tongue of the floorboard.
7. The activation lever has three settings: Forward, centre is Stop, and Reverse. To align the boards safely, the "Stop Go" (ie. moving the ram in repeated short movements) is the best way to operate the spring-to-centre switch. Repeat short forward movements until the boards become joined. You may need to tap the top of the floorboards to help align as the floor tool presses the boards together. If over-clamping occurs, the boards will rise upwards. Back off the pressure and apply weight downward on the main head and proceed again.
8. Nail off the board, release using reverse lever action on the air cylinder.
9. Re-position the tool along the same floorboard if necessary. Please note, the Extension head attachment is provided to allow extra pressure for straightening the most twisted and bent boards. Repeat steps 3 to 9 to use successfully.
10. Set up the next row of boards, slide the Extension poles back one notch (or more if appropriate). With the handle attached it is easy to manoeuvre out of the way when not in use. Clamp the floorboards where needed.
11. Continue through working your way down with the shorter Extension poles until you have no room left to use the main head.
12. To set up the Return bar (adaptor), remove all Extension poles, disconnect the Main head and reconnect the Return foot to the yoke. Connect the Return bar to the cylinder attachment and set up the Return bar head in the pushing direct by sliding it on and locking, pull and turn mechanism into position. Attach appropriate connecting blocks and repeat steps 7 to 11.
13. When the Return bar Head has reached its pushing capacity, reverse the Return bar Head relative to the rest of the tool so as to pull the floorboards together (as opposed to pushing them together). Continue steps 7 to 11 until you reach the last floorboard.

14. You are finished with the floor tool. Disconnect the air hose and dismantle the attachments. Pack up the kit.

The claims defining the invention are as follows:

1. A tool assembly including an expansion unit, a footing for placement at a first location engaged relative to an anchor surface, and a fitting for engaging a flooring panel, the footing being adapted to be positioned at the first location when the tool assembly is in a proximate mode, where the fitting is proximate the footing, and when the tool assembly is in a distance mode, where the fitting is spaced from the anchor surface at a distance greater than a width of at least one flooring panel, whereby to allow a series of floor panels to be laid and pushed together using a force generated by the expansion unit of the tool assembly, acting between an endmost flooring panel and the first location in both the proximate and distance modes, wherein when in the distance mode the fitting includes a head portion having spaced abutting arms extending from a base with each of the abutting arms having a projection below a surface of the abutting arm for pushing against the endmost flooring panel at spaced locations, and wherein when in the proximate mode the head portion is reversed, wherein the head portion comprises a locking mechanism which removably attaches and reverses the head portion such that the arms pull on the endmost flooring panel at spaced locations while the footing anchors the tool assembly, the spacing of the arms allowing fixing of the endmost flooring panel to an underlying surface at a location between the arms in both the proximate and distance modes.

2. A tool assembly as claimed in claim 1, adapted to allow the series of floor panels to be sequentially laid and pushed together using the force generated by the expansion unit of the tool assembly, acting between each successive endmost flooring panel and the first location in both the proximate and distance modes.

3. A tool assembly as claimed in claim 1, wherein when in the proximate mode the spaced abutting arms engage the endmost flooring panel at a location between ends of the tool assembly.

4. A tool assembly as claimed in claim 1, wherein when in the distance mode the footing includes an extendable portion for extending a length of the tool assembly, the extendable portion having a bearing portion for engagement relative to the anchor surface at a free end of the extendable portion.

5. A tool assembly as claimed in claim 1, wherein when in the proximate mode the footing includes a short foot portion having a bearing portion proximal to the expansion unit.

6. A tool assembly as claimed in claim 1, wherein the expansion unit is reversible between the proximal and distance modes.

7. A tool assembly as claimed in claim 1, wherein the base and the abutting arms define a substantially U-shape.

8. A tool assembly as claimed in claim 1, wherein the abutting arms are parallel to one another and the base extends laterally between the abutting arms.

9. A tool assembly as claimed in claim 1, wherein the abutting arms extend away from the base towards the footing when the tool assembly is in the proximate mode and the abutting arms extend away from the base and the footing when the tool assembly is in the distance mode.

10. A tool assembly for pressing together flooring panels to be fixed in place one relative to the other(s), the tool assembly having first and second parts movable one part relative to the other part for exerting force on an end flooring panel with anchorage on an anchor surface at a first location, wherein the tool assembly has a distance mode for pressing together the flooring panels when a distance between the first location and the end flooring panel is greater than a length of the second part of the tool assembly, and a proximal mode for pressing together the flooring panels when the distance between the first location and the end flooring panel is less than the length of the tool assembly, and wherein the tool assembly is adapted such that in both distance and proximal modes one part of the tool assembly is anchored by the anchor surface at the first location and the other part of the tool assembly exerts force on the end flooring panel, the first part of the tool assembly having a foot portion for providing anchorage against the anchor surface, the second part of the tool assembly having a head portion, the head portion comprising a locking mechanism and spaced abutting arms extending from a base, the locking mechanism removably attaches and reverses the head portion, each of the abutting arms having a projection below a surface of the abutting arm, whereby, in the distance mode the abutting arms are arranged such that the head portion pushes against the end flooring panel at spaced locations, in the proximate mode the head portion is reversed such that the arms pull on the end flooring panel at spaced locations while the foot portion anchors the tool assembly with respect to the anchor surface, and the spacing between the arms permits access for fastening said end flooring panel to an underlying surface at a location between the arms in both the proximate and distance modes.

11. A tool assembly as claimed in claim 10, wherein the anchor surface is a substantially vertical surface.

12. A tool assembly as claimed in claim 10, wherein the tool assembly is provided with an expansion unit coupled to the first and second parts, operable to move the second part relative to the first part.

13. The tool assembly as claimed in claim 12, wherein the expansion unit is power-operated.

14. The tool assembly as claimed in claim 12, wherein the expansion unit is pneumatically powered.

15. A tool assembly as claimed in claim 10, wherein the locking mechanism is configured to prevent relative movement between the first part and the second part.

16. The tool assembly as claimed in claim 10, wherein when in the proximate mode the spaced abutting arms engage the end flooring panel at a location between ends of the tool assembly.

17. A tool assembly as claimed in claim 16, wherein the head portion is interchangeable with other parts.

18. A tool assembly as claimed in claim 10, wherein the abutting arms extend away from the base towards the footing when the tool assembly is in the proximal mode and the abutting arms extend away from the base and the footing when the tool assembly is in the distance mode.

19. A method of pressing together flooring panels to be fixed in place one relative to the other(s), including the steps of:

providing anchorage with a first part of a tool assembly at a first location on an anchor surface;

selecting between a distance mode and a proximal mode of the tool assembly depending on a distance between an end flooring panel and the first location;

arranging a head portion of the tool assembly in position according to the distance mode or the proximal mode, the head portion including a locking mechanism which removably attaches and reverses the head portion, wherein, in the distance mode abutting arms of the head portion extend from a base with each of the abutting arms having a projection below a surface of the abutting arm and arranged to push against an end flooring panel at spaced locations, and in the proximate mode the head portion is reversed such that the arms pull on the end flooring panel at spaced locations between ends of the tool assembly while a footing anchors the tool assembly;

moving the second part relative to the first part to extend the tool assembly so as to move the end flooring panel relative to the anchor surface; and fastening said end flooring panel to an underlying surface at a location between the arms.

20. A method of pressing together flooring panels as claimed in claim 19, wherein the method includes the step of locking the head portion relative to the second part.

21. A method of pressing together flooring panels as claimed in claim 19, wherein the method includes the step of abutting a foot portion of the first part of the tool assembly against a substantially vertical anchor surface.

22. A method of pressing together flooring panels as claimed in claim 21, wherein the method includes the step of abutting the foot portion of the first part of the tool assembly against a wall.

23. A method of pressing together flooring panels as claimed in claim 19, wherein the abutting arms extend away from the base towards the footing when the tool assembly is in the proximate mode and the abutting arms extend away from the base and the footing when the tool assembly is in the distance mode.

* * * * *